US012179311B2

(12) United States Patent
Kuhlmann

(10) Patent No.: US 12,179,311 B2
(45) Date of Patent: Dec. 31, 2024

(54) DUST COVER FOR A CUTTING GRINDER

(71) Applicant: Hilti Aktiengesellschaft, Schaan (LI)

(72) Inventor: Kevin Kuhlmann, Kaufering (DE)

(73) Assignee: Hilti Aktiengesellschaft, Schaan (LI)

( * ) Notice: Subject to any disclaimer, the term of this patent is extended or adjusted under 35 U.S.C. 154(b) by 1477 days.

(21) Appl. No.: 16/605,633

(22) PCT Filed: Apr. 16, 2018

(86) PCT No.: PCT/EP2018/059652

§ 371 (c)(1),
(2) Date: Oct. 16, 2019

(87) PCT Pub. No.: WO2018/192869

PCT Pub. Date: Oct. 25, 2018

(65) Prior Publication Data

US 2020/0122292 A1 Apr. 23, 2020

(30) Foreign Application Priority Data

Apr. 20, 2017 (EP) ..... 17167204

(51) Int. Cl.
*B24B 55/05* (2006.01)
*B24B 23/02* (2006.01)
(Continued)

(52) U.S. Cl.
CPC ..... *B24B 55/052* (2013.01); *B24B 23/028* (2013.01); *B24B 27/08* (2013.01); *B24B 55/06* (2013.01); *B24B 31/12* (2013.01)

(58) Field of Classification Search
CPC ..... B24B 55/052; B24B 55/06; B24B 55/102; B24B 23/028; B24B 27/08; B24B 31/12
See application file for complete search history.

(56) References Cited

U.S. PATENT DOCUMENTS 5,951,746 A 9/1999 Treitz et al.
6,860,792 B2 3/2005 Krondorfer et al.
(Continued)

FOREIGN PATENT DOCUMENTS

CN 201586789 U 9/2010
CN 102415851 A 4/2012
(Continued)

OTHER PUBLICATIONS

WO-2015162193-A1 English Translation (Year: 2015).*
(Continued)

*Primary Examiner* — Makena S Markman
(74) *Attorney, Agent, or Firm* — Davidson Kappel LLC

(57) ABSTRACT

A dust hood (100), including a flange (90) for fastening the dust hood (100) to a transmission extension housing (210) of an angle grinder (200), and including a hood body (10) for covering a circular cutting wheel (220) on both sides, at least in sections, and including a suction connecting piece (40) for connecting a suction hose (400), via which removed substrate material (UG) may be extracted from the hood body (10), the dust hood (100) including a sensor unit (20), with the aid of which it is possible to detect whether the suction hose (20) is connected to the suction connecting piece (40) and/or whether a flap (45) of the suction connecting piece (40) is open.

6 Claims, 3 Drawing Sheets

(51) Int. Cl.

| | |
|---|---|
| ***B24B 27/08*** | (2006.01) |
| ***B24B 31/12*** | (2006.01) |
| ***B24B 55/06*** | (2006.01) |

(56) References Cited

U.S. PATENT DOCUMENTS

| | | | | |
|---|---|---|---|---|
| 7,309,365 | B2 * | 12/2007 | Yuasa | A47L 9/20 55/467 |
| 7,690,078 | B2 * | 4/2010 | Zahuranec | A47L 5/30 15/337 |
| 8,640,343 | B2 | 2/2014 | Rayner | |
| 9,073,160 | B2 | 7/2015 | Appel et al. | |
| 10,478,943 | B2 | 11/2019 | Nakamura et al. | |
| 10,870,216 | B2 | 12/2020 | Schell et al. | |
| 2009/0049699 | A1 | 2/2009 | Frenzel | |
| 2010/0024618 | A1 | 2/2010 | Minemura et al. | |
| 2012/0073077 | A1 | 3/2012 | Ishikawa et al. | |
| 2018/0281146 | A1 | 10/2018 | Tomonaga et al. | |

FOREIGN PATENT DOCUMENTS

| | | | | |
|---|---|---|---|---|
| CN | 102548718 | A | 7/2012 | |
| CN | 103128719 | A | 6/2013 | |
| CN | 203579754 | U | 5/2014 | |
| CN | 206085178 | U | 4/2017 | |
| DE | 4105373 | A1 * | 8/1992 | |
| JP | 2014133277 | A | 7/2014 | |
| JP | 2017052063 | A | 3/2017 | |
| KR | 100638349 | B1 | 10/2006 | |
| WO | WO 0243920 | A1 | 6/2002 | |
| WO | WO 2007029911 | A1 | 3/2007 | |
| WO | WO 2011041799 | A2 | 4/2011 | |
| WO | 2937031 | A1 | 10/2015 | |
| WO | WO-2015162193 | A1 * | 10/2015 | A47L 7/0095 |
| WO | WO2017051893 | A1 | 3/2017 | |

OTHER PUBLICATIONS

DE4105373A1 English Translation (Year: 1992).*
International Search Report of PCT/EP2018/059652, dated Oct. 31, 2018.

* cited by examiner

DUST COVER FOR A CUTTING GRINDER

The present invention relates to a dust hood, which includes a flange for fastening the dust hood to a transmission extension housing of an angle grinder. The dust hood is equipped with a hood body for the purpose of covering a circular cutting wheel on both sides, at least in sections, and it is equipped with a suction connecting piece for connecting a suction hose. Removed substrate material may be extracted from the hood body via the suction hose.

BACKGROUND

Dust hoods of the type mentioned at the outset are generally known from the prior art. They are used to avoid dust propagation during cutting work to protect the health of a user of the angle grinder.

SUMMARY OF THE INVENTION

It is an object of the present invention to provide a dust hood, which establishes the basis for safe cutting operation.

The present invention provides that the dust hood includes a sensor unit, with the aid of which it is possible to detect whether the suction hose is connected to the suction connecting piece and/or whether a flap of the suction connecting piece is open.

The present invention includes the finding that angle grinders are placed into use both with dust extraction and without dust extraction during practical deployment, i.e., for example, during dry cutting. During dry cutting without dust extraction, a circular cutting wheel of the angle grinder typically rotates in a co-rotating rotational direction to keep removed substrate material away from the user of the angle grinder. During dry cutting with dust extraction, the cutting wheel is typically driven in a contra-rotating rotational direction, which ensures better control of the kerf. It has been found that the possibility of operating an angle grinder in different rotational directions may result in operating errors, which, in turn, represent an undesirable dust exposure for the user. This is the case, for example, if the flap of the suction connecting piece is open, and no suction hose is connected to the suction connecting piece.

The dust hood according to the present invention establishes a basis for avoiding operating errors of this type. The sensor unit provided according to the present invention may be routed to an angle grinder, for example for the purpose of predefining the rotational direction of the cutting wheel of the angle grinder. For example, if the flap of the suction connecting piece is open and no suction hose is inserted into the suction connecting piece, it is possible to automatically predefine a co-rotating rotational direction of the cutting wheel, which is typically selected when no dust extraction takes place. However, if the flap of the suction connecting piece is open and the suction hose is inserted into the suction connecting piece or is connected thereto, a contra-rotating rotational direction is preferably predefined, since a proper dust extraction may be ensured.

In a particularly preferred embodiment, the dust hood includes a signal line, via which a sensor signal originating from the sensor unit may be tapped, preferably for the purpose of predefining the rotational direction of the cutting wheel of the angle grinder.

It has been proven to be advantageous if the signal line is guided through the flange of the dust hood. One or multiple interfaces may be provided on the flange, for example on an inner surface of the flange, which correspond to one or multiple interfaces on the transmission extension housing of the angle grinder. In the simplest case, the interface may have one or multiple electrical contact areas.

It has proven to be advantageous if the sensor unit includes a hood contact, with the aid of which it is possible to detect whether the flap of the suction connecting piece is open or closed. Alternatively or additionally, the sensor unit may include a connecting piece contact, with the aid of which it is possible to detect whether the suction hose is connected to the suction connecting piece.

In a particularly preferred embodiment of the dust hood, the sensor unit includes a hood contact, with the aid of which it is possible to detect whether the dust hood is connected to the angle grinder. The sensor signal of a hood contact may be evaluated by the angle grinder, for example in such a way that a rotation of the cutting wheel is prevented if no dust hood is connected to the angle grinder.

Different embodiments of the flap contact, the connecting piece contact and the hood contact are conceivable. The flap contact, the connecting piece contact and/or the hood contact may thus be provided, for example, in the form of a switch, a pushbutton, a magnetic contact or a light barrier. A sensor unit may also have a combination of switches, pushbuttons or the like.

In a first preferred embodiment, the flap contact is provided in the form of an ON/OFF slide switch. The slide switch is preferably actuated by the flap of the suction connecting piece. The flap of the suction connecting piece is preferably shaped in such a way that the slide switch is actuated upon opening the flap. By actuating the slide switch, the signal line in the form of an electrical loop may be either opened or closed, and rotational direction control electronics of the angle grinder may be preferably activated on the basis of this purely electrical signal.

The flap contact and the hood contact may also be functionally integrated, for example in the form of an ON/OFF/ON toggle switch, which is preferably actuated by the flap of the suction connecting piece. For example, it may be provided that the closed flap presses the toggle switch into a first ON position, the opened flap presses the toggle switch into a second ON position and/or the toggle switch assumes the OFF position (for example the middle position) if the dust hood is not situated on an angle grinder. A mechanical transmission link between the flap and the flange may be provided within the dust hood, for example in the form of a mechanical plunger, so that the toggle switch may be situated on the connecting piece in the area of the flap and be simultaneously able to detect, in terms of the hood contact, whether the dust hood is connected to the angle grinder.

In another preferred embodiment, the flap contact and the connecting piece contact are provided in the form of two pushbuttons. It is preferably provided that the closed flap actuates the first pushbutton, and the second pushbutton is actuated when the suction hose is inserted into the suction connecting piece. The pushbuttons may be situated in such a way that, if the flap is open and the suction hose is not connected to the suction connecting piece, neither of the two pushbuttons is pressed, which preferably causes the rotational direction control electronics to prevent a rotation of the cutting wheel of the angle grinder. In another preferred embodiment, the sensor unit includes only the flap contact, preferably in the form of a pushbutton.

As mentioned earlier, the flap contact, the connecting piece contact and/or the hood contact may be provided in a variety of forms. The flap contact and the connecting piece contact may thus be provided in the form of two light barriers, a closed flap interrupting the first light barrier, an open flap and/or an inserted suction hose preferably interrupting the second light barrier. It may be provided that a rotation of the cutting wheel is prevented by the rotational direction control electronics when neither the first light barrier nor the second light barrier is interrupted.

In another embodiment, only the flap contact is preferably provided in the form of a light barrier. It may be situated in such a way that the opened flap of the suction connecting piece interrupts the light barrier, and the closed flap does not interrupt the light barrier.

In another embodiment, the flap contact and the connecting piece contact may be provided in the form of magnetic contacts, for example reed switches. A closed flap preferably closes a first magnetic switch. An inserted suction hose may close a second magnetic switch. It is preferably provided that neither of the magnetic switches is actuated when the flap is open and the suction hose is not inserted, and a rotation of the cutting wheel—with respect to the angle grinder—is prevented in this case.

The functions of the flap contact, the connecting piece contact and/or the hood contact described above may, of course, also be logically inverted.

The invention also provides an angle grinder, which includes a transmission extension housing for connecting a dust hood of the type described above, the angle grinder including rotational direction control electronics, which, when the dust hood is connected, are connected by signals to the sensor unit via an interface in such a way that the rotational direction of the cutting wheel of the angle grinder may be predefined or is predefined as a function of a sensor signal coming from the sensor unit.

It has proven to be advantageous if the rotational direction control electronics are designed to prevent a rotation of the cutting wheel if no dust hood is connected to the angle grinder.

The angle grinder is preferably a handheld power tool. The angle grinder is particularly preferably battery-operated, i.e. in particular without a power cord.

The invention also provides a method for operating an angle grinder, the angle grinder including a dust hood equipped with a suction connecting piece, and the method including the following steps:

- Detecting whether a suction hose is connected to the suction connecting piece and/or whether a flap of the suction connecting piece is open with the aid of a sensor unit encompassed by the dust hood;
- Controlling a rotational direction of the cutting wheel of the angle grinder as a function of the state detected by the sensor unit.

The method may be refined accordingly by the features described above with reference to the devices.

The invention also provides a handheld power tool system, which includes an angle grinder of the type described above and a dust hood of the type described above.

Other advantages result from the following description of the figures. The figures illustrate different exemplary embodiments of the present invention. The figures, the description and the claims contain numerous features in combination. Those skilled in the art will advantageously also consider the features individually and combine them to form other reasonable combinations.

BRIEF DESCRIPTION OF THE DRAWINGS

In the figures, identical and equivalent components are provided with identical reference numerals.

DETAILED DESCRIPTION

Figure 1:
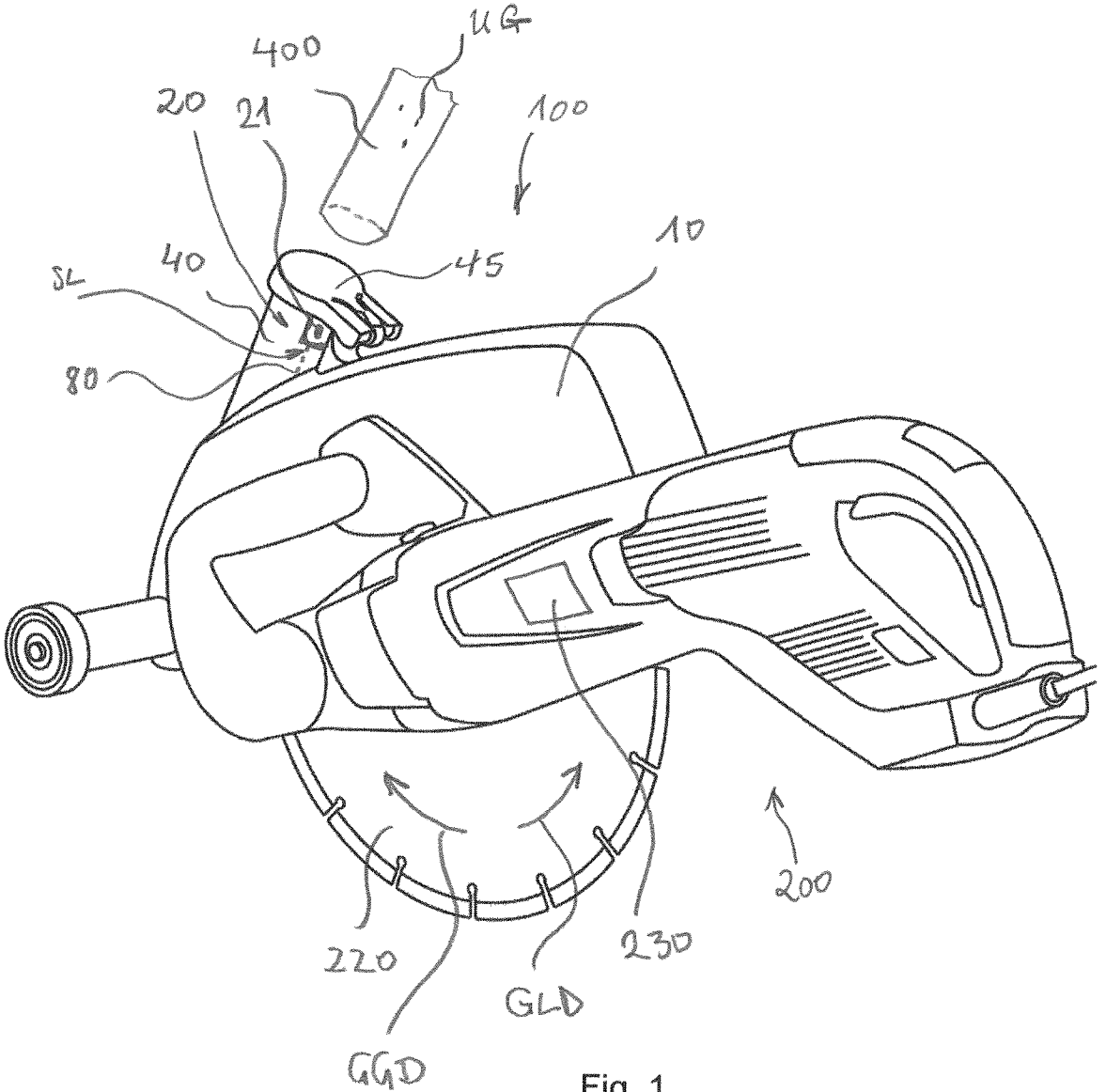
FIG. 1 shows a preferred exemplary embodiment of a dust hood according to the present invention, situated on an angle grinder according to the present invention.

FIG. 1 shows a preferred exemplary embodiment of a dust hood 100 according to the present invention, which is situated on an angle grinder 200 according to the present invention. Dust hood 100 includes a hood body 10 for the purpose of covering a circular cutting wheel 220 on both sides, at least in sections. Dust hood 100 is also equipped with a suction connecting piece 40 for connecting a suction hose 400. Removed substrate material UG in the form of dust from a kerf, which is not illustrated here, may be extracted from hood body 10 via suction connecting piece 40 and suction hose 400.

Dust hood 100 includes a sensor unit 20, with the aid of which it is possible to detect whether a flap 45 of suction connecting piece 40 is open.

In the present illustrated exemplary embodiment, sensor unit 20 includes a flap contact 21, with the aid of which it is possible to detect whether flap 45 of suction connecting piece 40 is open or closed. Flap contact 21 is designed as an ON/OFF slide switch, which is situated on suction connecting piece 40 in such a way that the slide switch is actuated into the ON position when flap 45 is opened.

Dust hood 100 includes a signal line 80, via which sensor signal SL originating from sensor unit 20 may be tapped for the purpose of predefining the rotational direction for cutting wheel 220 of angle grinder 200.

Angle grinder 200 itself includes rotational direction control electronics 230, which are connected by signals to sensor unit 20 via an interface (cf. FIG. 3: interface 240) when dust hood 100 is connected. The rotational direction of cutting wheel 220 may be predefined as a function of sensor signal SL coming from sensor unit 20.

In the exemplary embodiment illustrated in FIG. 1, flap 45 of suction connecting piece 40 is closed. Flap contact 21 of sensor unit 20 is connected to rotational direction control electronics 230 via signal line 80. It is provided, as an example, that flap contact 21 in the form of a slide switch is electrically open in the flap state in FIG. 1, and rotational direction control electronics 230 are configured in such a way that cutting wheel 220 is driven in co-rotating rotational direction GLD during the startup of angle grinder 200. This corresponds to a dry cutting operation without dust extraction.

If flap 45 is open, flap contact 21 in the form of a slide switch would be electrically closed, so that rotational direction control electronics 230 now activate angle grinder 200 in such a way that cutting wheel 220 is driven in contra-rotating rotational direction GGD in the case of a startup of angle grinder 200. This would correspond to a dry cutting with dust extraction. It should be noted that dust hood 100 in FIG. 1 is not configured to detect whether suction hose 400 is actually connected to suction connecting piece 40.

Figure 2:
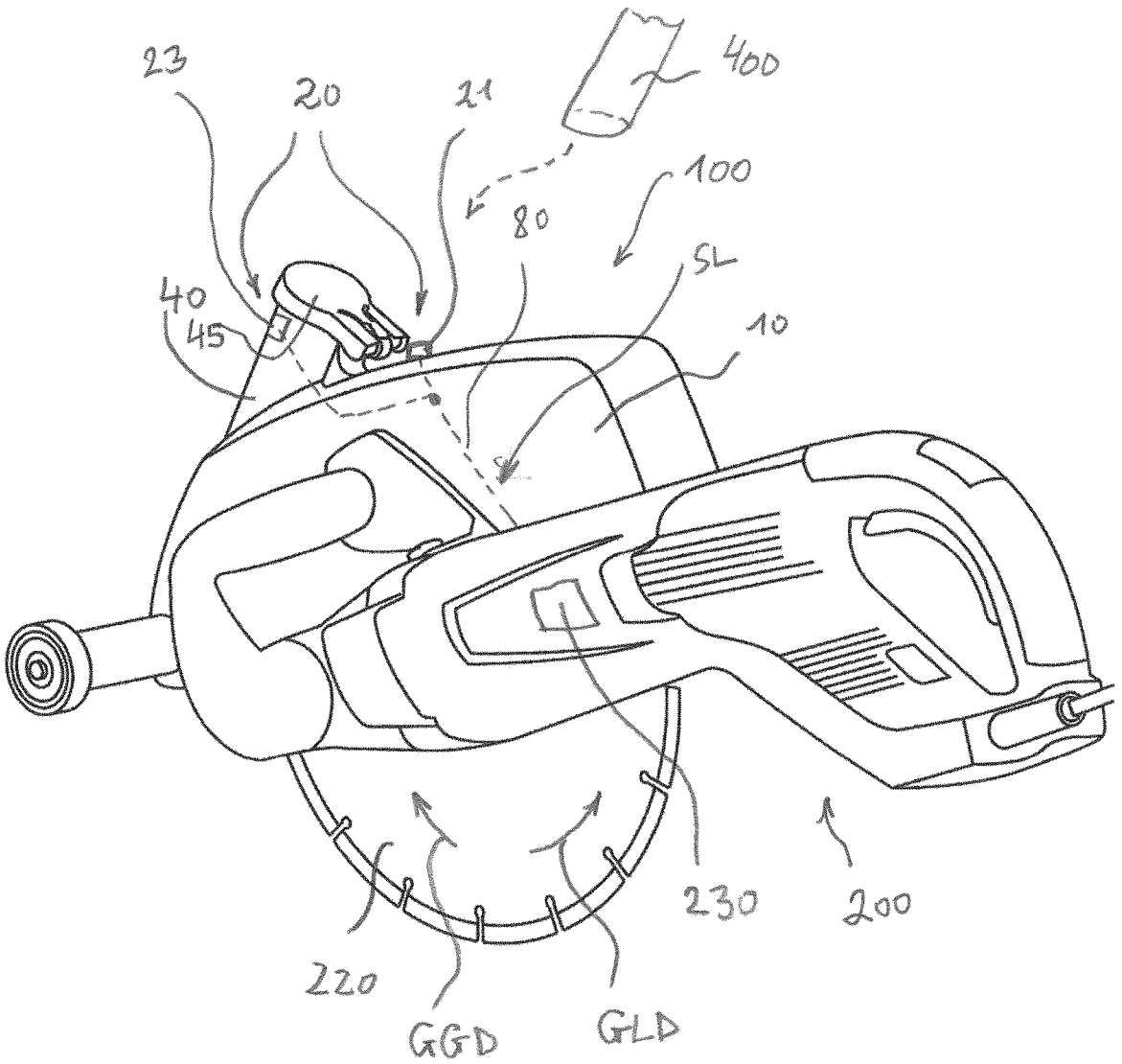
FIG. 2 shows another preferred exemplary embodiment of an angle grinder according to the present invention, including a dust hood.

However, this is the case in the exemplary embodiment in FIG. 2. Sensor unit 20 includes a flap contact 21, with the aid of which it is possible to detect whether flap 45 of suction connecting piece 40 is open or closed. In addition, sensor unit 20 includes a connecting piece contact 23, with the aid of which it is possible to detect whether suction hose 400 is connected to suction connecting piece 40. Flap contact 21 is provided in the form of a pushbutton to be actuated by opening flap 45. Connecting piece contact 23 is provided in the form of a pushbutton provided within suction connecting piece 40, which, in this case, for example, closes when suction hose 400 is inserted into suction connecting piece 40.

If flap 45 is closed (illustrated here), flap contact 21 in the form of a pushbutton is actuated, i.e. electrically closed. The rotational direction predefinition made by rotational direction control electronics 230 indicates a contra-rotating rotational direction GGD of cutting wheel 220.

If flap 45 is open, and flap contact 21 in the form of the pushbutton is not actuated, i.e. is electrically open, the rotational direction predefinition depends on the switching state of connecting piece contact 23.

If suction hose 400 is inserted into suction connecting piece 40, connecting piece contact 23 in the form of the internal pushbutton is actuated, i.e. electrically closed. The switching state of flap contact 21 and connecting piece contact 23 is transmitted in the form of what is now purely electrical sensor signal SL to rotational direction control electronics 230, which now specifies a contra-rotating rotational direction GGD of cutting wheel 220.

However, if suction hose 400 is not inserted into suction connecting piece 40 while flap 45 is open, correspondingly configured rotational direction control electronics 230 cause a rotation of cutting wheel 220 to be prevented even if the angle grinder is actuated. This is the case since it must be assumed that the dust passing through open flap 45 would harm the user of angle grinder 200.

Figure 3:
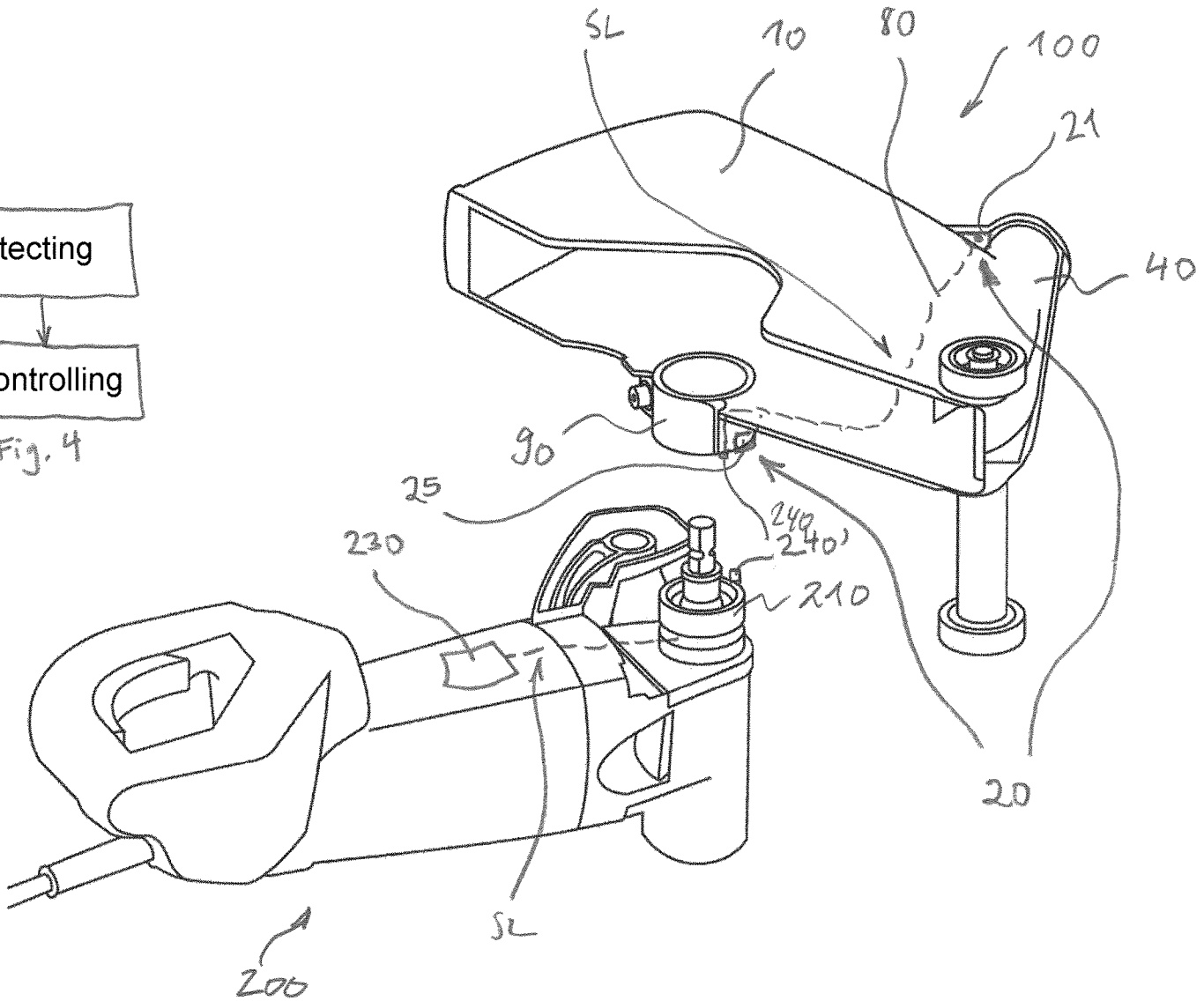
FIG. 3 shows another exemplary embodiment of an angle grinder according to the present invention, including a dust hood, the dust hood not being connected to the angle grinder.

FIG. 3 is essentially used to explain how sensor unit 20 is to be preferably coupled with rotational direction control electronics 230.

In the exemplary embodiment in FIG. 3, sensor unit 20 includes a flap contact 21, with the aid of which it is possible to detect whether flap 45 of suction connecting piece 40 is open or closed. In addition, the sensor unit includes a hood contact 25, with the aid of which it is possible to detect whether dust hood 100 is connected to angle grinder 200. Flap contact 21 and hood contact 25 may be provided, for example, in the form of pushbuttons as well as in the form of magnetic switches.

As is clearly apparent from FIG. 3, dust hood 100 includes a signal line 80, via which sensor signals SL coming from flap contact 21 and hood contact 25 may be tapped. To now enable a signal to be transmitted to dust hood 100 on angle grinder 200, more specifically to rotational direction control electronics 230, signal line 80 runs through flange 90 of the dust hood up to an electrical interface 240 on the flange. The transmission extension housing includes a corresponding interface 240, from which signal sensor SL reaches rotational direction control electronics 230 of the angle grinder.

Figure 4:
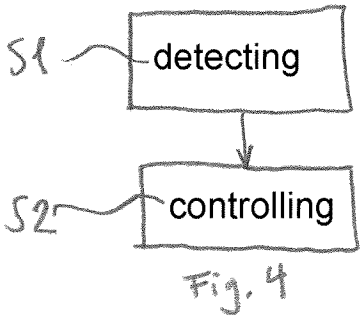
FIG. 4 shows a method according to the present invention for operating an angle grinder.

Finally, FIG. 4 shows a method for operating an angle grinder, for example an angle grinder of FIGS. 1 through 3. In a first method step S1, a detection takes place with the aid of a sensor unit encompassed by the dust hood as to whether a suction hose is connected to the suction connecting piece and/or whether a flap of the suction connecting piece is open. In a second step S2, a control of the rotational direction of the cutting wheel of the angle grinder takes place as a function of the state detected by the sensor unit.

LIST OF REFERENCE NUMERALS

10 hood body
20 sensor unit
21 flap contact
23 connecting piece contact
25 hood contact
40 suction connecting piece
45 flap
80 signal line
90 flange
100 dust hood
200 angle grinder
210 transmission extension housing
220 cutting wheel
230 rotational direction control electronics
240 interface
240 corresponding interface
400 suction hose
GGD contra-rotating rotational direction
GLD co-rotating rotational direction
SL sensor signal
S1, S2 method steps
UG removed substrate material

What is claimed is:

1. A method for operating an angle grinder, the angle grinder including a cutting wheel and a dust hood equipped with a suction connecting piece, the method including the steps:

detecting whether a suction hose is connected to the suction connecting piece or whether a flap of the suction connecting piece is open with the aid of a sensor unit encompassed by the dust hood; and controlling a rotational direction of the cutting wheel of the angle grinder as a function of the state detected by the sensor unit; wherein the sensor unit includes a flap contact to detect whether the flap is open or closed and a connecting piece contact to detect whether the suction hose is connected to the suction connecting piece; wherein the rotational direction includes a contra-rotating rotational direction corresponding to a dry cutting with dust extraction and a co-rotating direction corresponding to a dry cutting operation without dust extraction.

2. The method as recited in claim 1 wherein if the flap is closed, the rotational direction is set to the contra-rotating rotational direction.

3. The method as recited in claim 2 wherein if the flap is open, the rotational direction is set as a function of the connecting piece contact.

4. A method for operating an angle grinder, the angle grinder including a cutting wheel and a dust hood equipped with a suction connecting piece, the method including the steps:

detecting whether a suction hose is connected to the suction connecting piece or whether a flap of the suction connecting piece is open with the aid of a sensor unit encompassed by the dust hood; and controlling a rotational direction of the cutting wheel of the angle grinder as a function of the state detected by the sensor unit; wherein the sensor unit includes a flap contact to detect whether the flap is open or closed; wherein the rotational direction includes a contra-rotating rotational direction corresponding to a dry cutting with dust extraction and a co-rotating direction corresponding to a dry cutting operation without dust extraction.

5. The method as recited in claim 4 wherein if the flap is open, the rotational direction is set to the contra-rotating rotational direction.

6. The method as recited in claim 5 wherein if the flap is closed, the rotational direction is set to the co-rotating rotational direction.

* * * * *